US007500664B2

(12) United States Patent
Nakashima

(10) Patent No.: US 7,500,664 B2
(45) Date of Patent: Mar. 10, 2009

(54) IMAGE FORMING APPARATUS

(75) Inventor: Atsuhisa Nakashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 416 days.

(21) Appl. No.: 11/367,407

(22) Filed: Mar. 6, 2006

(65) Prior Publication Data

US 2006/0197271 A1 Sep. 7, 2006

(30) Foreign Application Priority Data

Mar. 4, 2005 (JP) ..... 2005-061665

(51) Int. Cl.
*B65H 5/00* (2006.01)

(52) U.S. Cl. ..... 271/10.1; 271/121; 271/126; 271/157; 271/167

(58) Field of Classification Search ..... 271/121, 271/126, 10.1, 10.13, 157, 167
See application file for complete search history.

(56) References Cited

U.S. PATENT DOCUMENTS 650,410 A * 5/1900 Morin ..... 271/121
2001/0024011 A1* 9/2001 Tamura ..... 271/10.1
2004/0201160 A1* 10/2004 Nakashima ..... 271/10.1
2005/0023744 A1* 2/2005 Okamoto ..... 271/113

FOREIGN PATENT DOCUMENTS

JP 2000289234 10/2000
JP 2002249259 9/2002

* cited by examiner

*Primary Examiner*—David H Bollinger
(74) *Attorney, Agent, or Firm*—Baker Botts L.L.P.

(57) ABSTRACT

An image forming apparatus includes a medium supply device having a lift plate and a lift mechanism positioning the lift plate The image forming apparatus also has a pickup roller a feeding device including a feeder member feeding each medium supplied from the supply device, and a nip roller pressing the medium onto the feeder member, and a recording portion recording an image on the medium fed by the feeding devices, and a multiple supply preventer. The multiple supply preventer contacts a leading edge of the medium to be supplied by the supply device and a leading edge of at least one other recording medium, and the upper end of the preventer is located below a straight line extending from a point between the pickup roller and topmost medium, to a point between the feeder member and nip roller.

11 Claims, 5 Drawing Sheets

IMAGE FORMING APPARATUS

INCORPORATION BY REFERENCE

The present application is based on Japanese Patent Application No. 2005-061665, filed on Mar. 4, 2005, the content of which is incorporated herein by reference.

BACKGROUND OF THE INVENTION

1. Field of the Invention

The present invention relates to an image forming apparatus, and particularly to an image forming apparatus which can prevent deterioration in accuracy in feeding a recording medium, without increasing the manufacturing cost.

2. Description of Related Art

An image forming apparatus typically includes a medium supply portion, and a feeder belt, between which is formed a supply path. A plurality of recording media is set in stack in the medium supply portion, and is supplied one by one into the supply path. The recording medium is then fed along the supply path to be passed onto the feeder belt, and thereafter carried on the feeder belt up to a position opposed to a recording portion including a recording head. While the recording medium is opposed to the recording head, the recording head ejects droplets of ink onto the recording medium in order to form a desired image on the recording medium.

JP-A-2002-249259 (see paragraph 0019 and FIG. 4) discloses an image forming apparatus including a supply path along which are arranged a pickup roller, a separator roller or a multiple supply preventer, and a skew eliminator or a guide member.

The pickup roller is rotated in contact with a topmost one of recording media or sheets stacked on a lift plate, in order to sequentially supply the recording media toward the multiple supply preventer. When the recording media are thus supplied by the pickup roller one by one, it is prevented, by the multiple supply preventer, that a plurality of the recording media are supplied at a time. Then, the supplied recording medium is passed onto a feeder belt with the position or orientation of the recording medium adjusted, or with skew of the recording medium eliminated, by the guide member.

By thus supplying the recording medium along the supply path, it is enabled to supply one by one the recording media stacked on the lift plate, while restricting the skew of each recording medium with respect to a supply direction in which the recording medium is supplied.

Once the recording medium is supplied onto the feeder belt, the multiple supply preventer and the guide member are separated away from the recording medium, by a lifting/lowering mechanism including a spring, a holding arm, and/or others. Thus, it is prevented that a tensile force in a direction opposite to the supply direction is generated by contact between the recording medium and each of the multiple supply preventer and the guide member, and such a tensile force acts on the recording medium. This in turn prevents deterioration in the accuracy of feeding of the recording medium.

However, the conventional arrangement disclosed in the above-mentioned publication requires the lifting/lowering mechanism including the spring, the holding arm, and/or others for preventing application of the tensile force in the direction opposite to the supply direction, to the recording medium. This increases the manufacturing cost.

SUMMARY OF THE INVENTION

This invention has been developed in view of the above-described situations, and it is an object of the invention, therefore, to provide an image forming apparatus that can prevent deterioration in the accuracy of feeding a recording medium, without increasing the manufacturing cost.

To attain the above object, the invention provides an image forming apparatus including:

- a medium supply device including:
  - a lift plate which supports a stack of recording media each in the form of a sheet;
  - a lift mechanism which positions the lift plate such that a topmost one of the recording media stacked on the lift plate is located at a pickup position; and
  - a pickup roller which rotates in contact with the topmost recording medium as positioned at the pickup position, in order to supply the topmost recording medium;
- a feeding device including:
  - a feeder member which feeds each recording medium as supplied from the medium supply device; and
  - a nip roller which presses the recording medium onto the feeder member;
- a recording portion which records an image on the recording medium as fed by the feeding device; and
- a multiple supply preventer disposed between the medium supply device and the feeding device such that the multiple supply preventer is inclined with respect to a supply direction in which the medium supply device supplies the recording medium, such that an upper end of the multiple supply preventer is located downstream of a lower end thereof in the supply direction, the multiple supply preventer preventing supply, at a time, of a plurality of the recording media, by contacting a leading edge of the recording medium to be supplied by the medium supply device and a leading edge of each of at least one other recording medium under the recording medium to be supplied in the stack,
- wherein the upper end of the multiple supply preventer is located below and spaced away from a straight line extending from a first contact point between the pickup roller and the topmost recording medium, to a second contact point between the feeder member and the nip roller.

In this apparatus, contact between the recording medium and the multiple supply preventer is precluded in a tense phase in supply of the recording medium, namely, during a period from a first moment when the recording medium begins to be fed by the feeder member to a second moment when the recording medium is separated from the pickup roller, during which period the pickup roller is rotated by the recording medium fed by the feeder member, thereby decreasing a tensile force given by the multiple supply preventer to the recording medium in a direction opposite to the supply direction. Hence, the conventionally required lifting/lowering mechanism for separating the multiple supply preventer away from the recording medium can be omitted, thereby enabling to decrease deterioration in the accuracy of feeding of the recording medium due to the tensile force in the direction opposite to the supply direction acting on the recording medium, without increasing the manufacturing cost of the apparatus.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described an image forming apparatus according to one embodiment of the invention, by referring to the accompanying drawings.

Figure 1:
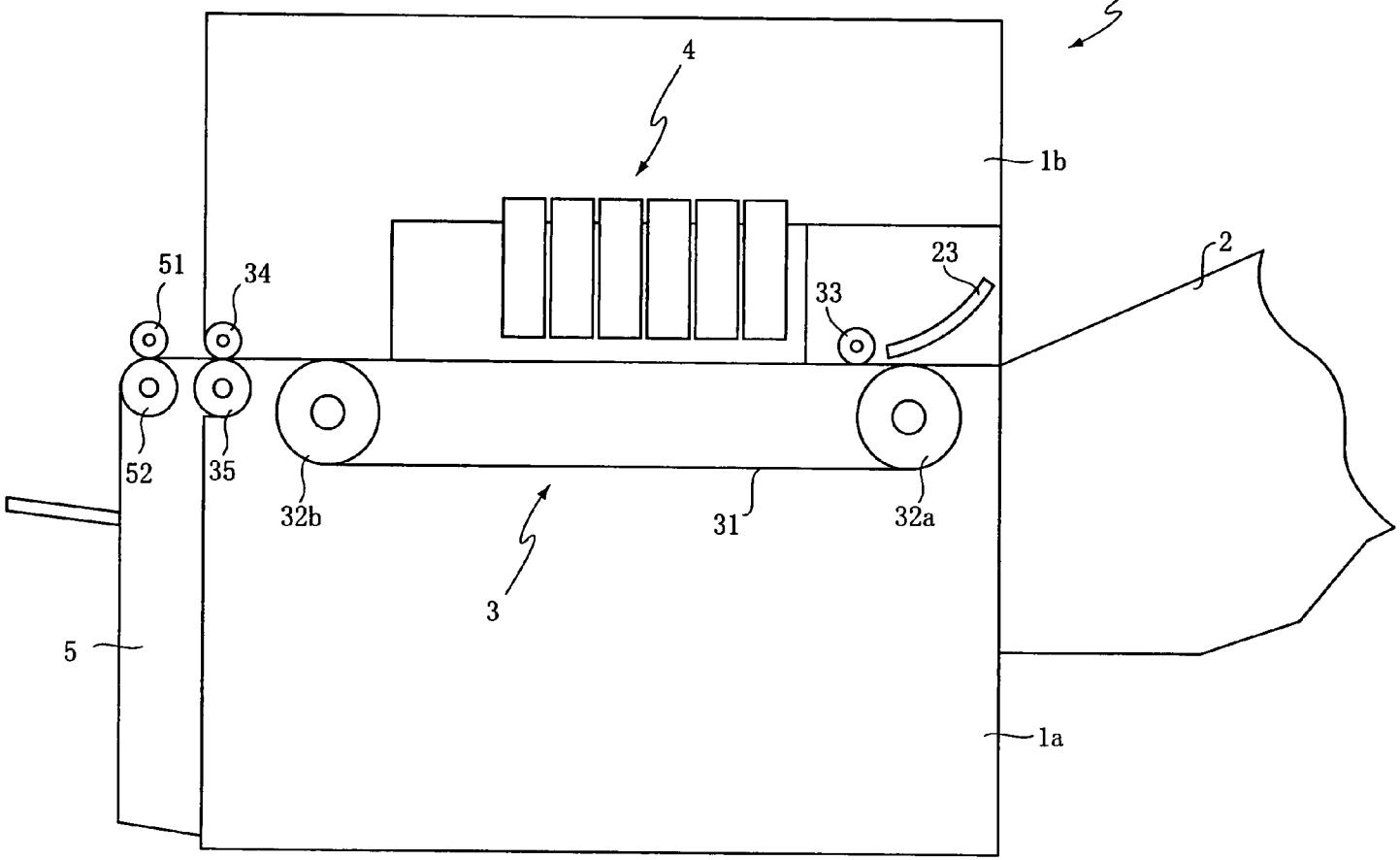
FIG. 1 is a schematic view of an image forming apparatus according to one embodiment of the invention.

Referring first to FIG. 1, there will be described a general structure of the image forming apparatus denoted by reference numeral 1.

The image forming apparatus 1 is principally constituted by a medium supply portion 2, a feeding portion 3, a recording portion 4, and a stacker 5. The feeding portion 3 and the recording portion 4 are included in a mainbody 1*a* of the apparatus 1. The medium supply portion 2 one by one supplies recording media 22 (shown in FIG. 2) into the mainbody 1*a*. The feeding portion 3 feeds the recording medium 22 supplied from the medium supply portion 2. The recording portion 4 includes a plurality of recording heads 4 that form an image by ejecting droplets of ink onto the recording medium 22 as being supplied the feeding portion 3. The stacker 5 receives the recording media 22 each with the image recorded thereon.

Figure 2:
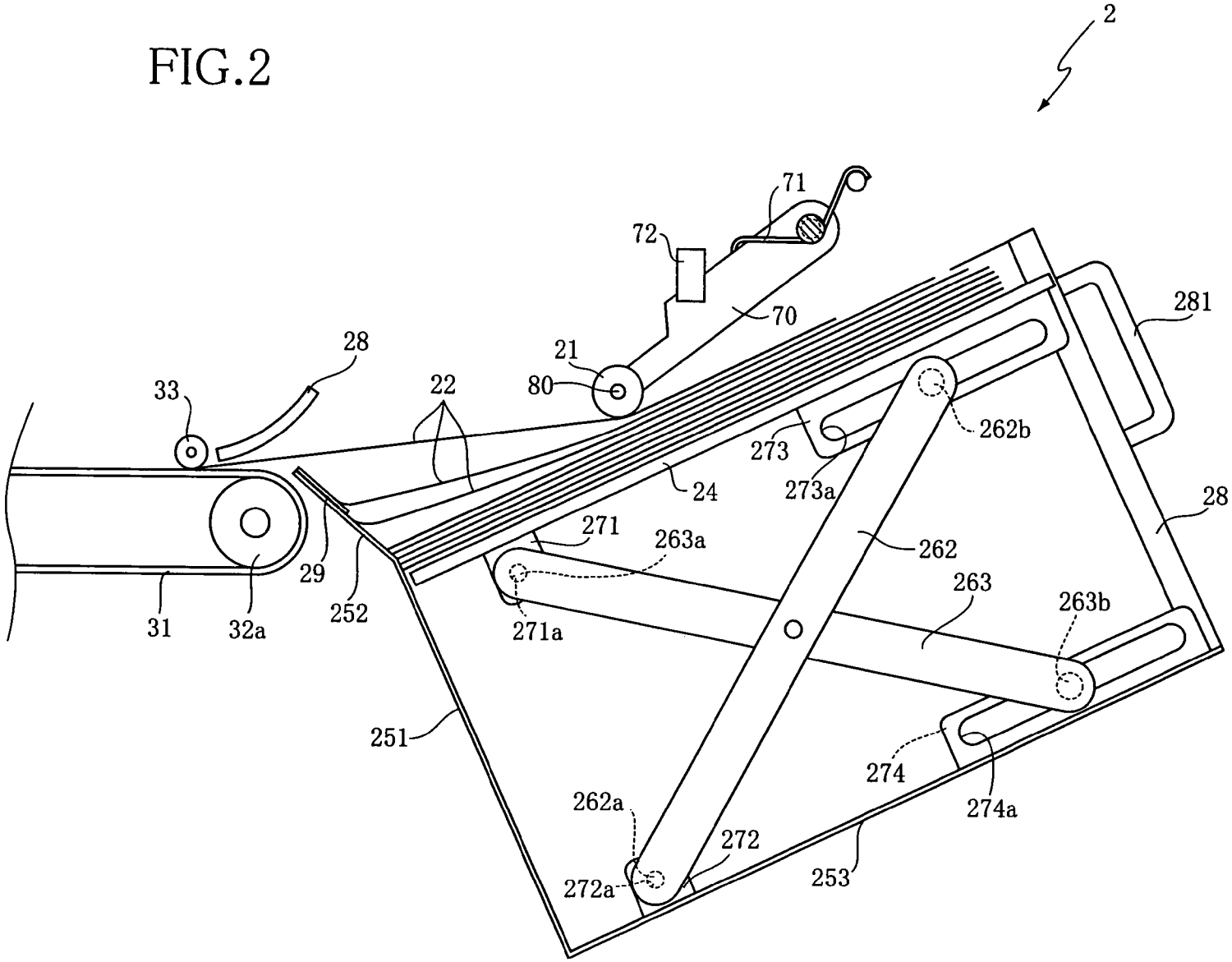
FIG. 2 is a schematic side view showing an internal structure of a medium supply portion and a part of a feeding portion in the image forming apparatus.
Figure 3:
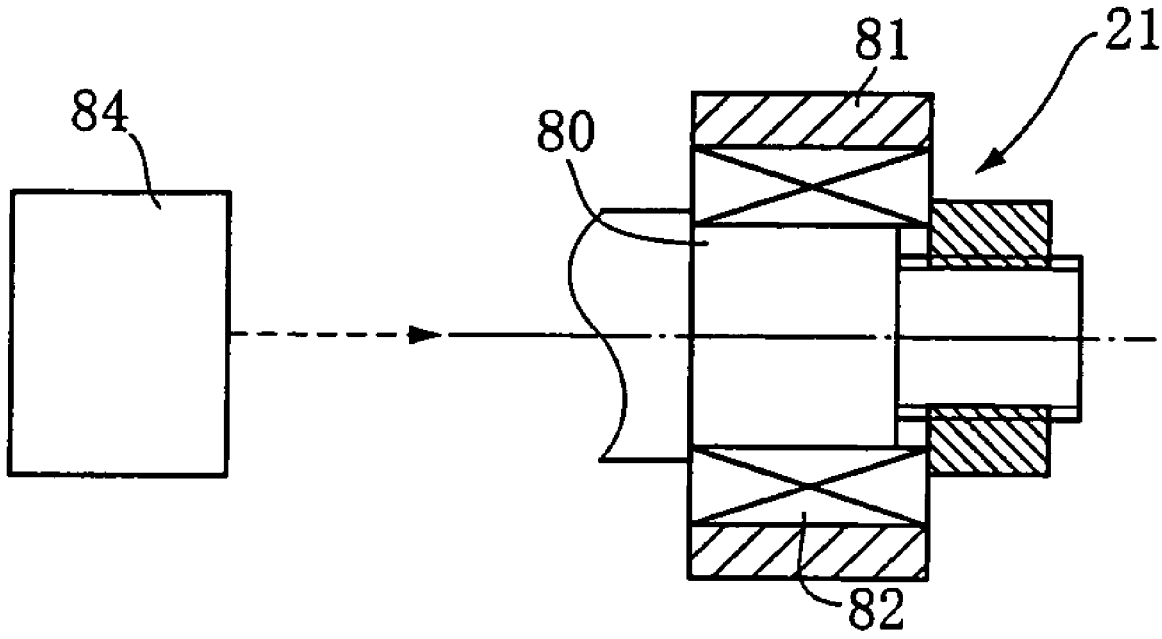
FIG. 3 is a cross-sectional view of a pickup roller in the medium supply portion.

More specifically, the medium supply portion 2 accommodates a stack of the recording media 22 and sequentially supplies the recording media 22 into the feeding portion 3. The topmost one of the recording media 22 in the medium supply portion 2 is in contact with a pickup roller 21, which includes a drive shaft 80, a roller member 81, and a one-way clutch 82 interposed between the drive shaft 80 and the roller member 81, as shown in FIG. 3. The drive shaft 80 is rotatably held by one of opposite ends of an arm 70, which is pivotably supported at the other end thereof, as shown in FIG. 2. The arm 70 is held biased downward by a spring 71 (shown in FIG. 2) or by other means. A drive force of an electric actuator 84 (shown in FIG. 3) is supplied to the drive shaft 80 of the pickup roller 21 to rotate the drive shaft 80 in the clockwise direction as seen in FIG. 1, and the one-way clutch 82 transmits the rotation of the drive shaft 80 to the roller member 81. The one-way clutch 82 permits free rotation of the roller member 81 relative to the drive shaft 80 in the clockwise direction.

Upon supply of the recording medium 22 into the feeding portion 3, skew of the recording medium 22 is eliminated by a guide member 23 disposed on the downstream side (i.e., the left-hand side as seen in FIG. 1) of the medium supply portion 2 with respect to a direction in which the recording medium 22 is supplied to the feeding portion 3. This direction may be referred to as "supply direction", and each indication of direction related to upstream or downstream side, portion, and others in the description below is that with respect to this supply direction. An operation to supply the recording media into the feeding portion 3 will be described later.

In the feeding portion 3 is formed a medium supply path along which the recording medium 22 supplied from the medium supply portion 2 is fed to the stacker 5. The medium supply path is principally defined by an endless feeder belt 31 wound around a pair of rollers 32*a*, 32*b*. The roller 32*b* is a drive roller, and the roller 32*a* is a driven roller. A side of the feeder belt 31 on which the recording medium 22 is carried, that is, an outer circumferential surface of the feeder belt 31 is siliconized and adhesive such that the recording medium 22 supplied from the medium supply portion 2 is held on the outer circumferential surface by adhesion. The recording medium 22 is fed to the downstream side by counterclockwise rotation of the drive roller 32*b*.

A nip roller 33 is disposed to inhibit the recording medium 22 as carried on the outer circumferential surface of the feeder belt 31, from getting off of that surface of the feeder belt 31. That is, the recording medium 22 is nipped between the nip roller 33 and the feeder belt 31 at an upstream position in the medium supply path, with the nip roller 33 pressing the recording medium 22 against the outer circumferential surface of the feeder belt 31.

A pair of medium ejection rollers 34, 35 are disposed on the downstream side of the feeder belt 31, in order to eject the recording medium 22 having been fed by the feeder belt 31, onto the stacker 5.

Each of the recording heads of the recording portion 4 is elongate and fixed in a head unit 1*b*, with a longitudinal direction of the recording head parallel to a width direction of the recording medium 22, i.e., a direction perpendicular to a surface of the sheet in which FIG. 1 is presented. In a surface of the recording head which is opposed to the outer circumferential surface of the feeder belt 31, there are formed a plurality of nozzles from which ink is ejected in the form of droplets. While the recording medium 22 fed by the feeder belt 31 passes under the nozzles, that is, passes on the lower side of the nozzles as seen in FIG. 1, ink droplets are ejected onto an upper surface, i.e., an image forming surface, of the recording medium 22 in order to form a desired image on the recording medium 22.

In an image forming apparatus having a plurality of nozzles through which ink is ejected in the form of droplets, such as an inkjet image forming apparatus, timing of ejecting ink droplets greatly affects the quality of the formed image. Hence, by preventing deterioration in the accuracy in feeding the recording medium in the way as described later, the timing of ejecting ink droplets is maintained appropriately, thereby preventing degradation in the image quality.

The recording head is of line head type that is fixed to a mainbody of an image forming apparatus. However, it may be arranged such that the recording head is movable to a position corresponding to a maintenance device when a maintenance operation is to be performed.

As shown in FIG. 1, the recording portion 4 includes a group of recording heads, namely, six recording heads that eject droplets of inks of respective colors, namely, cyan, light cyan, magenta, light magenta, yellow, and black, so that a color image can be formed as desired on the recording medium 22. However, the group of recording heads may consist of only four recording heads, namely, recording heads for cyan, magenta, yellow, and black, respectively. Alternatively, the group of recording heads may consist of more than six recording heads.

The head unit 1*b* is pivotably supported by the mainbody 1*a*, at a position downstream of the feeder belt 31, i.e., on the left-hand side thereof 31 as seen in FIG. 1. That is, the head unit 1*b* is displaceable in a vertical direction as seen in FIG. 1, by being turned around an axis. Hence, in the case of paper jam, a necessary work operation can be implemented from the side of the medium supply portion 2.

The stacker 5 receives and holds in stack the recording media 22 on each of which an image has been recorded. Another pair of medium ejection rollers 51, 52 is disposed on the downstream side of the medium ejection rollers 34, 35, in order to nips and directs the recording medium 22 as ejected from the feeding portion 3, onto the stacker 5.

Referring next to FIG. 2, there will be described in detail the medium supply portion 2. FIG. 2 is a schematic side view showing an internal structure of the medium supply portion 2, in which a clearance between each adjacent two recording media 22 is exaggerated, for facilitating comprehension of the invention.

The medium supply portion 2 accommodates the recording media 22 and supplies the recording media 22 one by one onto the feeder belt 31. The medium supply portion 2 includes: the pickup roller 21 that rotates in contact with the topmost one of the stack of recording media 22, thereby supplying leftward (as seen in FIG. 2) the topmost recording medium 22 onto the feeder belt 31; a lift plate 24 on which are stacked the recording media 22 that are to be sequentially brought into contact with the pickup roller 21; and a lift mechanism for lifting and lowering the lift plate 24.

The pickup roller 21 can be held in contact with the topmost one of the stack of the recording media 22 on the lift plate 24. By clockwise (as seen in FIG. 2) rotating the pickup roller 21, the topmost recording medium 22 is supplied onto the feeder belt 31. The pickup roller 21 is disposed at a vertical position above the outer circumferential surface of the feeder belt 31 on which each recording medium 22 is carried.

The guide member 23 is disposed on the upstream side (the right-hand side as seen in FIG. 2) of the nip roller 33, and extends over the feeder belt 31 and across a width of the feeder belt 31, that is, extends in a direction perpendicular to a surface of the sheet in which FIG. 2 is presented. The guide member 23 can contact a leading edge, in a supply direction or a lateral direction as seen in FIG. 2, of each recording medium 22 as supplied into the feeding portion 3 by operation of the pickup roller 21. By being brought into contact with the guide member 23, the recording medium 22 is directed to a nip between the 23, the recording medium 22 is directed to a nip between the feeder belt 31 and the nip roller 33, while skew of the recording medium 22 with respect to the supply direction is eliminated, if any.

FIG. 2 illustrates a tense phase in supplying a recording medium 22 into the feeding portion 3 where the recording medium 22 becomes tense and substantially linear in side view, by being nipped between the feeder belt 31 and the nip roller 33 at its leading portion, while in contact with the pickup roller 21 at a portion on the upstream side of the leading portion. That is, once the recording medium 22 as started to be supplied toward the feeding portion 3 by driving the pickup roller 21 with the drive force from the electrical actuator 84 begins to be fed by the feeder belt 31 and the nip roller 33, the supplying of the recording medium 22 enters the tense phase, that is, the recording medium 22 is now fed by being nipped between the circulated feeder belt 31 and the rotated nip roller 33 so that the roller member 81 of the pickup roller 21 held in contact with the recording medium 22 is rotated relative to the drive shaft 80 by the fed recording medium 22, since the speed of feeding of the recording medium 22 by cooperation of the feeder belt 31 and the nip roller 33 is higher than that by operation of the pickup roller 21 driven by the drive shaft 80, or since the drive shaft 80 is stopped. After an entirety of the topmost recording medium 22 has passed under the pickup roller 21, the pickup roller 21 contacts the next recording medium 22 that is immediately under the previously supplied recording medium 22, and after an appropriate time period has elapsed, the electric actuator 84 starts to rotate and the pickup roller 21 begins to supply the next recording medium 22 toward the feeding portion 3.

While the recording medium 22 is tense in this way, that is, by being nipped between the feeder belt 31 and the nip roller 33 and held downward by the pickup roller 21, the image forming surface of the recording medium 22 is located below or spaced from the guide member 23. That is, in the tense phase in supplying of the recording medium 22 in which the recording medium 22 is made tense, if the guide member 23 contacts the tense recording medium 22, a tensile force in a direction (i.e., the rightward direction as seen in FIG. 2) opposite to the supply direction (i.e., the leftward direction as seen in FIG. 2) is applied to the recording medium 22, thereby deteriorating the accuracy of the feeding.

However, according to the present embodiment, the contact between the recording medium 22 and the guide member 23 is precluded in order to prevent deterioration in the accuracy of the feeding.

The lift plate 24 is provided as a member on which recording media 22 are stacked. The lift plate 24 is capable of being lifted and lowered by the lift mechanism that is fully described later, in order to enable contact between the topmost one of the stack of recording media 22 and the pickup roller 21.

In this relation, in the invention, the term "pickup position" refers to a position where the topmost one of the recording media 22 stacked on the lift plate 24 is brought into contact with the pickup roller 21, by an upward movement of the lift plate 24.

Maintaining the topmost recording medium 22 at the pickup position irrespectively of consumption of the recording media, or of other factors, is accomplished by using a sensor 72 (shown in FIG. 2), for instance. That is, a sensor 72 fixed in position is provided in order to keep detecting an upper portion of the arm 70 that holds the pickup roller 21. When the sensor 72 comes not to detect the upper portion of the arm 70, a signal indicating this fact is outputted to a controller (not shown) that controls an operation of the lift mechanism (described later) to move the lift plate 24 to a position such that the sensor 72 can again detect the upper portion of the arm 70, thereby maintaining the lift plate 24 at an appropriate position to have the current topmost recording medium 22 in contact with the pickup roller 21.

A surface of the lift plate 24 on which the recording media 22 are stacked is inclined downward toward the feeder belt 31, such that there a contact portion 252 as a multiple supply preventer (described later) is located below or spaced from the recording medium 22 supplied into the feeding portion 3, in the tense phase in supplying that recording medium 22. That is, the outer circumferential surface of the feeder belt 31 on which the recording medium 22 is carried and the surface of the lift plate 24 on which recording media 22 are stacked forms an angle smaller than 180 degrees (e.g., 150 degrees). Thus, it is prevented with a simple structure that the tensile force in the recording medium 22 due to a resistance of the contact portion 252 to the supply of the recording medium 22, thereby preventing the deterioration in the feeding accuracy.

In other words, if the contact portion 252 contacts the recording medium 22 in the tense phase in supplying the recording medium 22 during which the recording medium 22 is tense, a tensile force in the direction (i.e., the rightward direction as seen in FIG. 2) opposite to the supply direction (i.e., the leftward direction as seen in FIG. 2) is applied to the recording medium 22 to act to pull out the recording medium 22 from the nip between the feeder belt 31 and the nip roller 33, thereby deteriorating the feeding accuracy. However, in the present embodiment, the contact between the recording medium 22 and the contact portion 252 is precluded, thereby preventing such deterioration in the feeding accuracy.

A conventional image forming apparatus includes a lifting/lowering mechanism for a guide member and a multiple supply preventer to space each of the guide member and the multiple supply preventer from a recording medium, in order to prevent that a tensile force in the direction opposite to the supply direction of the recording medium is applied to the recording medium in the tense phase in supplying the recording medium. However, in the image forming apparatus 1 of the invention, the guide member 23 and the contact portion 252 as a multiple supply preventer does not require such a lifting/lowering mechanism to space each of the guide member 23 and the contact portion 252 from the recording medium, thereby reducing the manufacturing cost accordingly.

The medium supply portion 2 includes a front wall plate 251 that is a plate-like member located between the lift plate 24 and the feeder belt 31. The front wall plate 251 vertically extends along a direction of stacking of the recording media 22 on the lift plate 24, and is inclined such that the front wall plate 251 is more on the side of the feeder belt 31 at an upper end thereof than at a lower end thereof.

An inclination of the front wall plate 251 is substantially identical with that of a vertical movement of the lift plate 24.

The contact portion 252 is a plate-like member with which the leading edge of each recording medium 22 as supplied into the feeding portion 3 by the pickup roller 21 is brought into contact, thereby preventing a plurality of recording media 22 supplied at a time. The contact portion 252 extends obliquely upward as seen in FIG. 2, and continuously from an upper end of the front wall plate 251. An upper end of the contact portion 252 is located more on the side of the feeder belt 31 than a phantom line extended straight from the front wall plate 251 along a direction of extension of the front wall plate 251. Thus, in the tense phase in supplying the recording medium 22, a relatively wide clearance can be ensured between the recording medium 22 and the contact portion 252, thereby reliably preventing contact between the recording medium 22 and the contact portion 252. According to this arrangement, a clearance between the recording medium 22 and the contact portion 252 is ensured, and a distance between the feeder belt 31 and the contact portion 252 can be made small, thereby preventing the recording medium 22 from dropping through a gap between the feeder belt 31 and the contact portion 252. Thus, the recording medium 22 can be reliably passed onto the feeder belt 31.

The medium supply portion 2 includes a bottom wall plate 253. The front wall plate 251 extends upward from an edge of the bottom wall plate 253 on one of opposite sides in the supply direction. The lift mechanism (described later) is disposed on an upper side of the bottom wall plate 253.

A separating member 29 is disposed for reliably separating the topmost recording medium 22 supplied by the pickup roller 21, from another recording medium or media under the topmost recording medium 22 in the stack. That is, the separating member 29 has a frictional resistance larger than that of an internal surface of the front wall plate 251 and the contact portion 252, and is disposed on a surface of the contact portion 252 on the side of the lift plate 24, i.e., the surface thereof on the right-hand side as seen in FIG. 2, such that the leading edge, in the supply direction, of the recording medium 22 as supplied by the pickup roller 21 is brought into contact with the separating member 29. Hence, each of the recording media 22 is separated from the other recording media 22 with a reliability higher than the case where the separating member 29 is not disposed on the contact portion 252, thereby reliably preventing a plurality of recording media 22 supplied together at a time.

The lift mechanism operates to lift and lower the lift plate 24, and includes a pair of link members 262, 263, a pair of pivotal engaging portions 271, 272, and a pair of slide engaging portions 273, 274.

As shown in FIG. 2, the link members 262, 263 are combined by means of a shaft 261 in a manner like scissors. At an end of each of the link members 262, 263 on a side (i.e., on the left-hand side as seen in FIG. 2), the first engaging pin 262*a*, 263*a* is disposed. At the other end of each link member 262, 263 on the opposite side (i.e., on the right-hand side as seen in FIG. 2), the second engaging pin 262*b*, 263*b* is disposed. The first engaging pins 262*a*, 263*a* rotatably engage with respective engaging holes 272*a*, 271*a* formed in the pivotal engaging portions 272, 271 disposed on the bottom wall plate 253 and the lift plate 24, respectively. The second engaging pins 262*b*, 263*b* are slidably engaged with slots 273*a*, 274*a* that are respectively formed in a pair of slide engaging portions 273, 274 disposed on the lift plate 24 and the bottom wall plate 253, respectively.

That is, each of the link members 262, 263 is pivotably held at one of two opposite ends thereof, while the other end of the link member 262, 263 is held to be slidable in a direction substantially parallel to the surface of the lift plate 24 on which the recording media are stacked, thereby allowing an operation of the link members 262, 263 that entails a vertical movement of the lift plate 24.

The medium supply portion 2 includes a pivotable member 28 that is pivotably supported by the bottom wall plate 253. On a surface of the pivotable member 28 on the upstream side (i.e., the right-hand side as seen in FIG. 2), there is fixed a grip 281. The pivotable member 28 will be described in detail later.

Figure 4A:
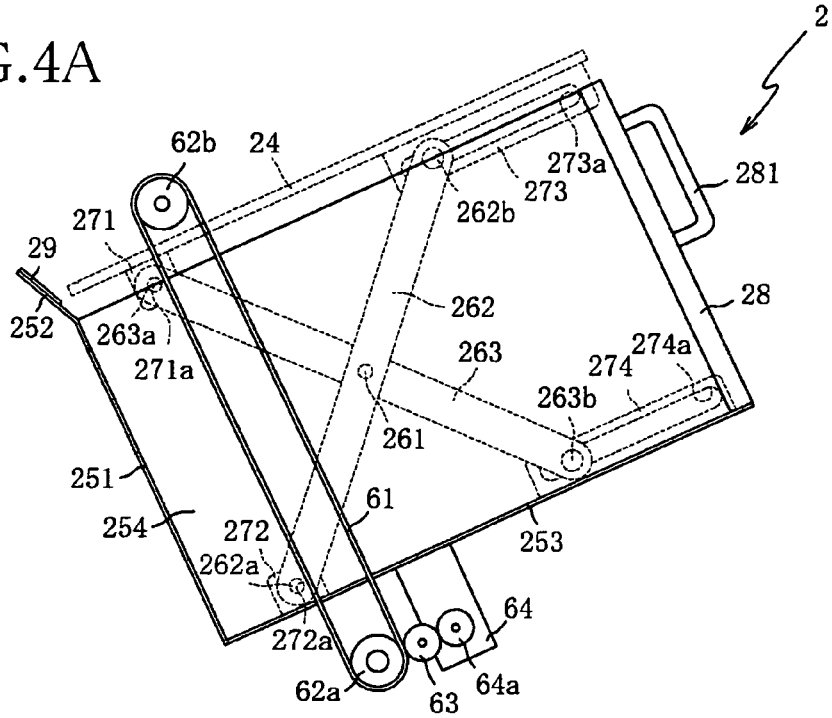
FIGS. 4A and 4B are side views of the medium supply portion, with a lift plate at a lifted position and an intermediately lowered position, respectively.
Figure 4B:
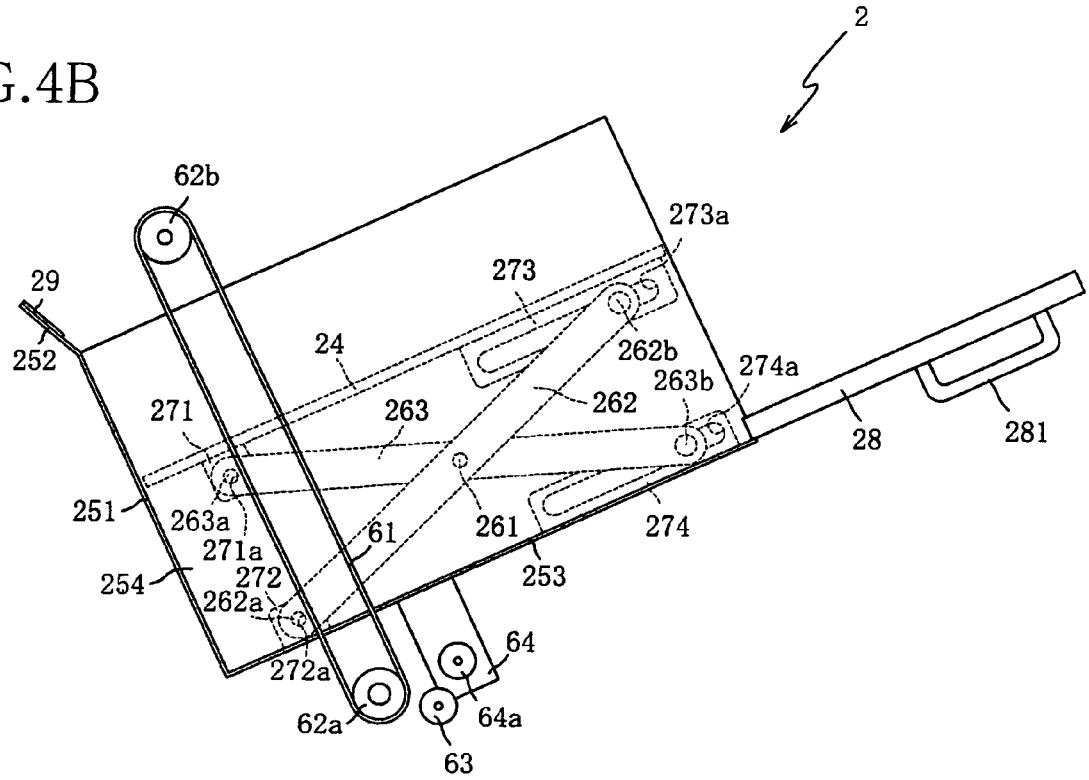

Referring now to FIGS. 4A and 4B, there will be described the lift plate 24. FIGS. 4A and 4B are internal side views of the medium supply portion 2 in states where the lift plate 24 is lifted, and lowered, respectively.

As shown in FIG. 4A, a motor 64 is disposed below the bottom wall plate 253, i.e., on the lower side as seen in FIG. 4A. A motor gear 64*a* is engaged with the motor 64 to be rotatable by driving the motor 64. A disengagement gear 63 is disposed on the downstream side of the motor gear 64*a*, i.e., on the left side thereof as seen in FIG. 4A. The disengagement gear 63 is rotatable with rotation of the motor gear 64*a*.

A side wall plate 254 is disposed continuously with the front wall plate 251 as well as the bottom wall plate 253. At a side (i.e., the near side as seen in FIG. 4A) of the side wall plate 254, an endless lifting/lowering belt 61 is wound around lifting/lowering rollers 62*a*, 62*b*. The lifting/lowering roller 62*a* engages with the disengagement gear 63 such that the lifting/lowering roller 62*a* rotates with rotation of the disengagement gear 63. Rotation of the lifting/lowering roller 62*a* circulates the lifting/lowering belt 61.

The lift plate 24 is lifted by circulation of the lifting/lowering belt 61. In this way, the motor 64 is rotated to move the lift plate 24 upward, that is, the rotation of the motor 64 is transmitted to the lift plate 24 via the motor gear 64*a*, the disengagement gear 63, the lifting/lowering rollers 62*a*, 62*b*, and the lifting/lowering belt 61.

In this relation, in the invention, the term "drive device" refers to a combination of the motor 64, the motor gear 64*a*, the disengagement gear 63, the lifting/lowering rollers 62*a*, 62*b*, and the lifting/lowering belt 61. The driving device lifts the lift plate 24 by driving the motor 64.

In the invention, the term "retaining mechanism" refers to a combination of the motor 64, the motor gear 64*a*, the disengagement gear 63, the lifting/lowering rollers 62*a*, 62*b*, and the lifting/lowering belt 61. With termination of rotation of the motor 64, the circulation of the lifting/lowering belt 61 is terminated, which in turn halt the upward moving lift plate 24. The lift plate 24 is thereafter held at the halted position.

The disengagement gear 63 is lowered when the pivotable member 28 is turned downward by a user, thereby disengaging the motor gear 64*a* from the lifting/lowering roller 62*a*. More specifically, when the lift plate 24 is desired to be lowered, which may be when the medium supply portion 2 is to be replenished with recording media 22 or when a stack of recording media is to be set on the lift plate 24, the pivotable member 28 is turned open to the upstream side in the supply direction, that is, turned rightward as seen in FIG. 4B. The turn-opening of the pivotable member 28 lowers the disengagement gear 63, that is, moves the disengagement gear 63 downward as seen in FIG. 4B, thereby inhibiting transmission of a driving force of the motor 64 to the lifting/lowering belt 61. In other words, the "retaining mechanism" is disengaged and the lift plate 24 lowers down to its lowermost position by gravity, thereby omitting a drive device for lowering the lift plate 24 is unnecessary. This leads to reduction in the manufacturing cost.

In this relation, in the invention, the term "release mechanism" refers to a combination of the pivotable member 28 and the disengagement gear 63. Turning the pivotable member 28 lowers the disengagement gear 63.

Figure 5:
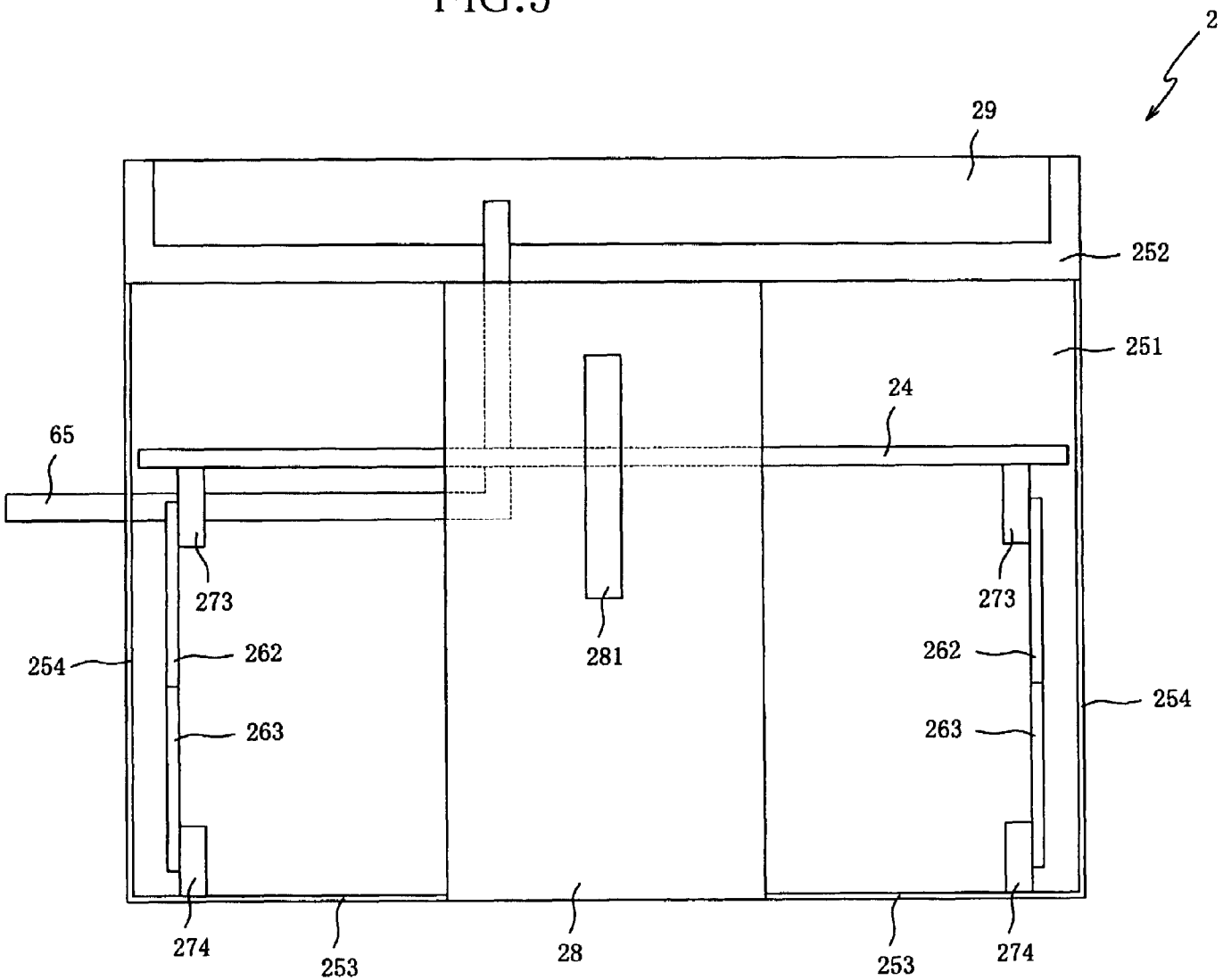
FIG. 5 is a rear view of the medium supply portion, and a view thereof as seen from the uppermost stream side with respect to a direction in which a recording medium is supplied.

Referring now to FIG. 5, there will be described a positioning member 65. FIG. 5 is a rear view of the medium supply portion 2, i.e., a view thereof as seen from the upstream side in the supply direction.

As shown in FIG. 5, the positioning member 65 is L-shaped or having two segments one of which extends through the lift plate 24 and the other of which extends through the side wall plate 254. The positioning member 65 is movable in the width direction of the recording media 22 (shown in FIG. 2) as set on the lift plate 24, i.e., the lateral direction as seen in FIG. 5. Thus, there is established a state where an end, namely, the left-hand end as seen in FIG. 5, of the stack of recording media 22 in a predetermined size as set on the lift plate 24 is in contact with the positioning member 65, and the other end namely, the right-hand end as seen in FIG. 5, of the stack is in contact with another side wall plate 254 (the right-hand one in FIG. 5) opposite to the side wall plate 254 through which the positioning member 65 extends. Thus, recording media 22 of various sizes can be properly set on the lift plate 24 with the widthwise position of the recording media adjusted to the right as seen in FIG. 4.

In the present embodiment, the positioning member 65 is disposed only at one of opposite sides of the lift plate 24 in the width direction. However, a pair of positioning members may be disposed at both of opposite sides of the lift plate 24 in the width direction. In the case where a pair of positioning members are used, widthwise movements of the positioning members are synchronized in order to position the recording media 22 at a widthwise center.

Although there has been described one embodiment of the invention only by way of example, it is to be understood that the invention is not limited to the details of the embodiment but may be embodied with various modifications and improvements, without departing from the scope and spirit of the invention.

For instance, although in the above-described embodiment a plurality of discrete sheets are used as recording media 22, the recording medium set on the lift plate 24 may take other forms, such as roll paper.

In the embodiment the image forming apparatus 1 is of line-head type employing a line head as a recording head, the principle of the invention is equally applicable to any image forming apparatus including a recording head capable of recording an image while being reciprocated.

The image forming apparatus 1 is an inkjet image forming apparatus, but the principle of the invention is equally applicable to an image forming apparatus that employs any other recording methods as long as the image forming apparatus can record an image on a recording medium that is fed by a feeder member.

What is claimed is:

1. An image forming apparatus comprising:

a medium supply device including:

a lift plate which supports a stack of recording media each in the form of a sheet;

a lift mechanism which positions the lift plate such that a topmost one of the recording media stacked on the lift plate is located at a pickup position; and a pickup roller which rotates in contact with the topmost recording medium as positioned at the pickup position, in order to supply the topmost recording medium;

a feeding device including:

a feeder member which feeds each recording medium as supplied from the medium supply device; and a nip roller which presses the recording medium onto the feeder member;

a recording portion which records an image on the recording medium as fed by the feeding device; and a multiple supply preventer disposed between the medium supply device and the feeding device such that the multiple supply preventer is inclined with respect to a supply direction in which the medium supply device supplies the recording medium, such that an upper end of the multiple supply preventer is located downstream of a lower end thereof in the supply direction, the multiple supply preventer preventing supply, at a time, of a plurality of the recording media, by contacting a leading edge of the recording medium to be supplied by the medium supply device and a leading edge of each of at least one other recording medium under the recording medium to be supplied in the stack, wherein the upper end of the multiple supply preventer is located below and spaced away from the recording medium, when the recording medium is in a tense phase in supply thereof.

2. The image forming apparatus according to claim 1, wherein the feeder member is a feeder belt which is circulated by a belt drive mechanism.

3. The image forming apparatus according to claim 1, wherein the lift plate is disposed in a position inclined with respect to a horizontal plane such that the lift plate lowers toward the downstream side with respect to the supply direction.

4. The image forming apparatus according to claim 1, wherein the medium supply device includes a front wall plate which is inclined with respect to a vertical direction to the same side as the multiple supply preventer but at a smaller angle than the multiple supply preventer, and the lower end of the multiple supply preventer is continuous from an upper end of the front wall plate.

5. The image forming apparatus according to claim 1, further comprising a separating member disposed on a surface of the multiple supply preventer with which the leading edge of the recording medium contacts, the separating member having a frictional resistance larger than that of the multiple supply preventer.

6. The image forming apparatus according to claim 1, further comprising a guide member disposed between the multiple supply preventer and the feeder member, the guide member guiding the recording medium as being supplied toward the feeder member to be supplied thereto by the pickup roller, into a nip between the feeder member and the nip roller, the guide member being located above and spaced away from said straight line.

7. The image forming apparatus according to claim 1, wherein the recording portion includes a recording head having a plurality of nozzles from which ink is ejected in the form of droplets.

8. The image forming apparatus according to claim 7, which is a line printer in which the nozzles are arranged in a row extending in a direction intersecting with a feeding direction in which the medium is supplied to the recording portion, in plan view.

9. An image forming apparatus comprising:

a medium supply device comprising:

a lift plate which supports a stack of recording media each in the form of a sheet;

a lift mechanism which positions the lift plate such that a topmost one of the recording media stacked on the lift plate is located at a pickup position; and a pickup roller which rotates in contact with the topmost recording medium as positioned at the pickup position, in order to supply the topmost recording medium;

a feeding device comprising:

a feeder member which feeds each recording medium as supplied from the medium supply device; and a nip roller which presses the recording medium onto the feeder member;

a recording portion which records an image on the recording medium as fed by the feeding device; and a multiple supply preventer disposed between the medium supply device and the feeding device such that the multiple supply preventer is inclined with respect to a supply direction in which the medium supply device supplies the recording medium, such that an upper end of the multiple supply preventer is located downstream of a lower end thereof in the supply direction, the multiple supply preventer preventing supply, at a time, of a plurality of the recording media, by contacting a leading edge of the recording medium to be supplied by the medium supply device and a leading edge of each of at least one other recording medium under the recording medium to be supplied in the stack, and wherein the lift mechanism includes:

a drive device which moves the lift plate to the pickup position;

a retaining mechanism which holds the lift plate at the pickup position after the lift plate is moved to the pickup position by the drive device; and a release mechanism which makes the retaining mechanism release the lift plate from the held state where the lift plate is held at the pickup position, the lift plate as released from the held state lowering down to a lowermost position thereof, by gravity.

10. The image forming apparatus according to claim 9, wherein the pickup roller is held by a roller holder which is biased downward, wherein the apparatus further comprises a sensor which detects the roller holder and outputs a detection signal, and wherein the drive device includes an electrical actuator which operates to move the lift mechanism and stop the lift mechanism according to the detection signal, in order to control the position of the lift plate.

11. The image forming apparatus according to claim 9, wherein the pickup roller includes a drive shaft, a roller member, and a one-way clutch interposed between the drive shaft and the roller member, the one-way clutch permits relative rotation of the roller member to the drive shaft in a first direction corresponding to the supply direction, but inhibits relative rotation of the roller member to the drive shaft in a second direction opposite to the first direction.

* * * * *